US007845911B2

(12) United States Patent
Karem

(10) Patent No.: US 7,845,911 B2
(45) Date of Patent: Dec. 7, 2010

(54) SHAPED ROTOR BLADE FOR REDUCED LOADS AND VIBRATION

(76) Inventor: Abe Karem, 1018 Timberline La., Tustin, CA (US) 92705

( * ) Notice: Subject to any disclaimer, the term of this patent is extended or adjusted under 35 U.S.C. 154(b) by 458 days.

(21) Appl. No.: 11/505,040

(22) Filed: Aug. 15, 2006

(65) Prior Publication Data

US 2007/0253826 A1 Nov. 1, 2007

Related U.S. Application Data

(60) Provisional application No. 60/708,804, filed on Aug. 15, 2005.

(51) Int. Cl.
*B64C 27/46* (2006.01)
*B64C 27/473* (2006.01)

(52) U.S. Cl. ..... 416/237; 416/238; 416/240

(58) Field of Classification Search ..... 416/131, 416/132 A, 132 R, 134 A, 135, 228, 237, 416/238, 240, 500
See application file for complete search history.

(56) References Cited

U.S. PATENT DOCUMENTS 2,614,640 A * 10/1952 Buivid ..... 416/140
3,135,334 A * 6/1964 Culver ..... 416/18
3,999,886 A 12/1976 Ormiston et al.
4,099,892 A 7/1978 Martin
5,111,676 A 5/1992 Ruzicka, Jr. et al.
6,116,857 A * 9/2000 Splettstoesser et al. ..... 416/228
6,190,132 B1 * 2/2001 Yamakawa et al. ..... 416/228
6,582,196 B1 * 6/2003 Andersen et al. ..... 416/202

FOREIGN PATENT DOCUMENTS

JP 06056093 A * 3/1994

* cited by examiner

*Primary Examiner*—Edward Look
*Assistant Examiner*—Dwayne J White
(74) *Attorney, Agent, or Firm*—Fish & Associates, PC

(57) ABSTRACT

Rotor blades are pre-bent in at least one of a flap direction and a lag direction, wherein the pre-bent portion comprises at least 20-60% of the length of the blade. Preferred methods include analyzing the rotor dynamic behavior using computational methods, deciding on the operational case (rotor lift load, forward speed, etc.) in which the loads and vibration reductions are desired, and using the computed results to decide on an amount of pre-bending of the unloaded blade so that it comes closer to the feather axis under load. Another class of preferred methods models the bending of a first blade in flight loading conditions, and then designs a second blade having a pre-bend in approximately an equal in magnitude and opposite in direction to the bending. It is contemplated that such "pre-bent" blades can significantly reduce rotor loads and vibration levels of rotorcraft equipped with semi-rigid or rigid rotors.

14 Claims, 5 Drawing Sheets

SHAPED ROTOR BLADE FOR REDUCED LOADS AND VIBRATION

This application claims priority to U.S. Provisional Application Ser. No. 60/708,804 filed Aug. 15, 2005.

FIELD OF THE INVENTION

The field of the invention is rotorcraft.

BACKGROUND

The blades of a rotorcraft rotor in hover have the same airspeed, angle of attack and lift coefficient as the rotor rotates. In forward flight the blade rotating in the direction of the flight (advancing blade) has the rotorcraft airspeed in addition to the airspeed due to the rotor angular velocity. The blade rotating opposed to the direction of the flight (retreating blade) has its airspeed due to rotor angular velocity reduced by the vehicle airspeed.

Rotors consist of aerodynamically shaped blades attached to a rotating mast at the center of rotation. In some rotors (teetering rotors) the blades are attached to a hub which is free to teeter one blade up, opposing blade down. In other rotors (articulated rotors) the hub is rigidly attached to the rotating mast and the blades are attached to the hub, at a point outboard of the center of rotation, by an articulated attachment allowing the blades to flap up and down. In other rotors (semi-rigid rotors) the blades are attached to the rotating mast through a flexible hub which allows the blades to flap up or down proportionally to up or down moment applied by the blade on the hub. The blades of rigid rotors are rigidly attached to the hub and the rotating mast in the up-down flap direction.

To allow for rotorcraft control and maneuver, the rotor blades are either supported on bearing or on elastic blade retention, both of these methods provide for controlling the pitch angle of the blade as it rotates. The pitch control axis at the root of the blade is called feather axis. Aerodynamic and inertia loads deflect the blade away from the feather axis.

The varying aerodynamic lift, drag and pitch moment on the individual blade as it rotates in forward flight create oscillatory loads on the rotor. The aerodynamic and dynamic characteristics of the rotor determine the dynamic response of the rotor to such loads; which, in turn, effect the movement of the blade and therefore the blade lift, drag and pitch moment. In the last 3 decades, developers have used sophisticated and complex computerized analysis to predict rotor loads, and to thereby drastically reduce rotorcraft vibration.

Nevertheless, some of the remaining rotor loads (especially pitch link loads) and vibration levels of rigid and semi-rigid rotors, are the result of prior art blades having been built "straight" along the axis of blade rotation in pitch, which is defined herein as the "feather axis". The bending of such blades under lift, drag, and centrifugal forces, moves the blade away from the feather axis, thereby producing unnecessary vibration. The vibration in turn substantially affect passenger acceptance, crew fatigue, life of the rotor components, failure rate of the rotor system, empty weight of the rotorcraft, and the cost of operating the rotorcraft per flight hour.

In the prior art, proprotor and other rotor blades have been altered away (bent down) from the blade feather axis to improve aerodynamic performance and/or reduce rotor acoustic signature (noise level). But such modifications away from the feather axis have been always limited to about the outermost 10% of the radius from the rotor center of rotation, R90 and R80, respectively. Those limited modifications are not enough to reduce rotor loads and vibrations to anywhere near a minimum achievable amount. Thus, there is still a need for design and implementation of rotor blades and rotorcraft having reduced vibration.

SUMMARY OF THE INVENTION

The present invention provides apparatus and methods in which the rotor blades are not straight, but pre-bent in a manner calculated to more closely realize a straight blade feather axis while under load. It is contemplated that such "pre-bent" blades can significantly reduce rotor loads and vibration levels of rotorcraft equipped with semi-rigid or rigid rotors.

In one aspect of preferred embodiments, a rotorcraft has a rotor blade that in an unloaded state has a pre-bent portion in at least one of a flap direction and a lag direction, and wherein the pre-bent portion comprises at least 20%, more preferably at least 40%, and most preferably at least 60% of a length of the blade. In another aspect, a blade has a feathering axis, and the pre-bent portion is sized and dimensioned such that a flight loaded condition exits for which the pre-bent portion lies along the feathering axis. In yet another aspect, a distal end of the pre-bent portion in the unloaded condition forms an angle of at least 1°, and more preferably at least 2° with a root of the blade. In any event, the pre-bent portion can advantageously be in at least one of the flap and lag directions.

One class of preferred methods analyses the rotor dynamic behavior using computational methods, decides on the operational case (rotor lift load, forward speed, etc.) in which the loads and vibration reductions are desired, and uses the computed results to decide on an amount of pre-bending of the unloaded blade so that it comes closer to the feather axis under load. Another class of preferred methods models the bending of a first blade in flight loading conditions, and then designs a second blade having a pre-bend in approximately an equal in magnitude and opposite in direction to the bending. That process can be iterated to develop additional designs, each hopefully approximating the feather axis under load.

Various objects, features, aspects and advantages of the inventive subject matter will become more apparent from the following detailed description of preferred embodiments of the invention, along with the accompanying drawings in which like numerals represent like components.

DETAILED DESCRIPTION

Figure 1:
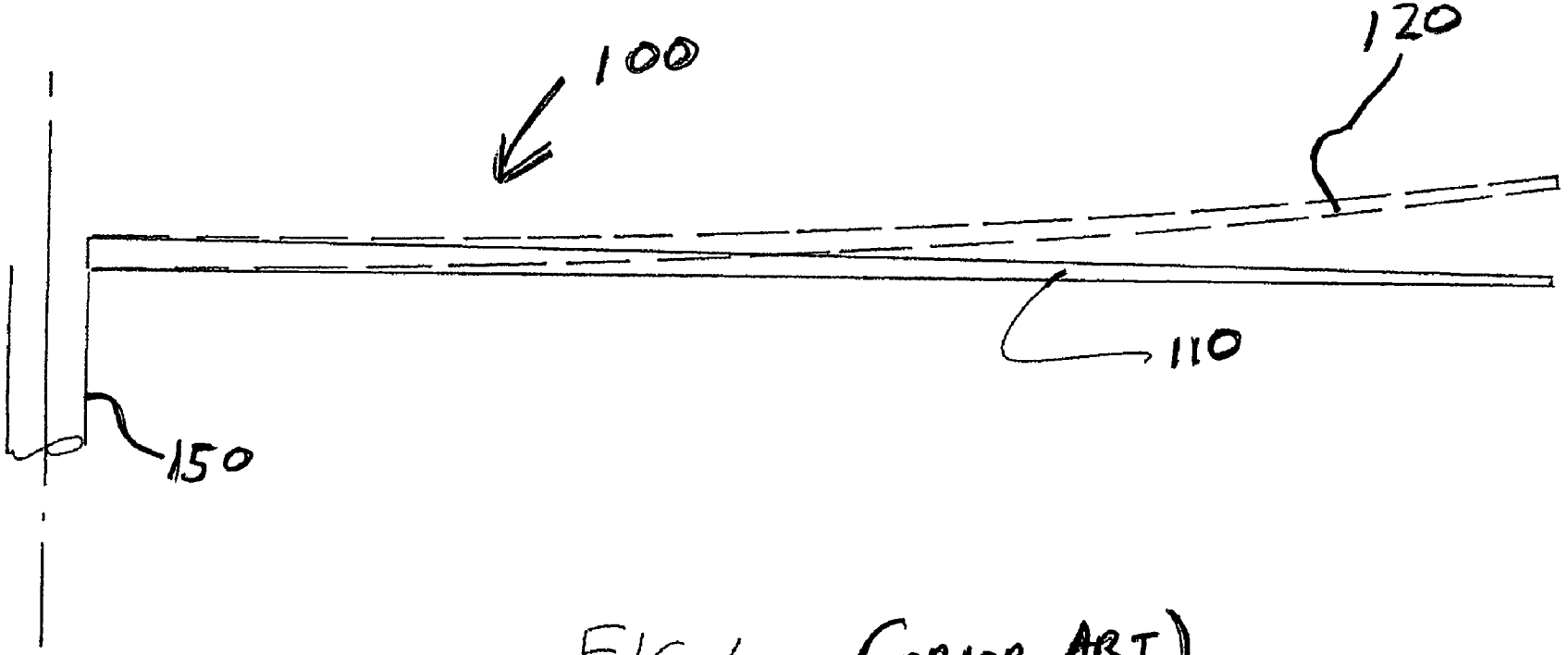
FIG-1 (PRIOR ART)
FIG. 1 is a front view of a prior art "straight" rotor blade, showing unloaded and loaded configurations.

In FIG. 1 a rotor blade 100 extends from a rotating mast 150. Unloaded the blade 100 takes the configuration 110, and under lifting load the blade takes the configuration 120 shown in dashed lines.

Figure 2:
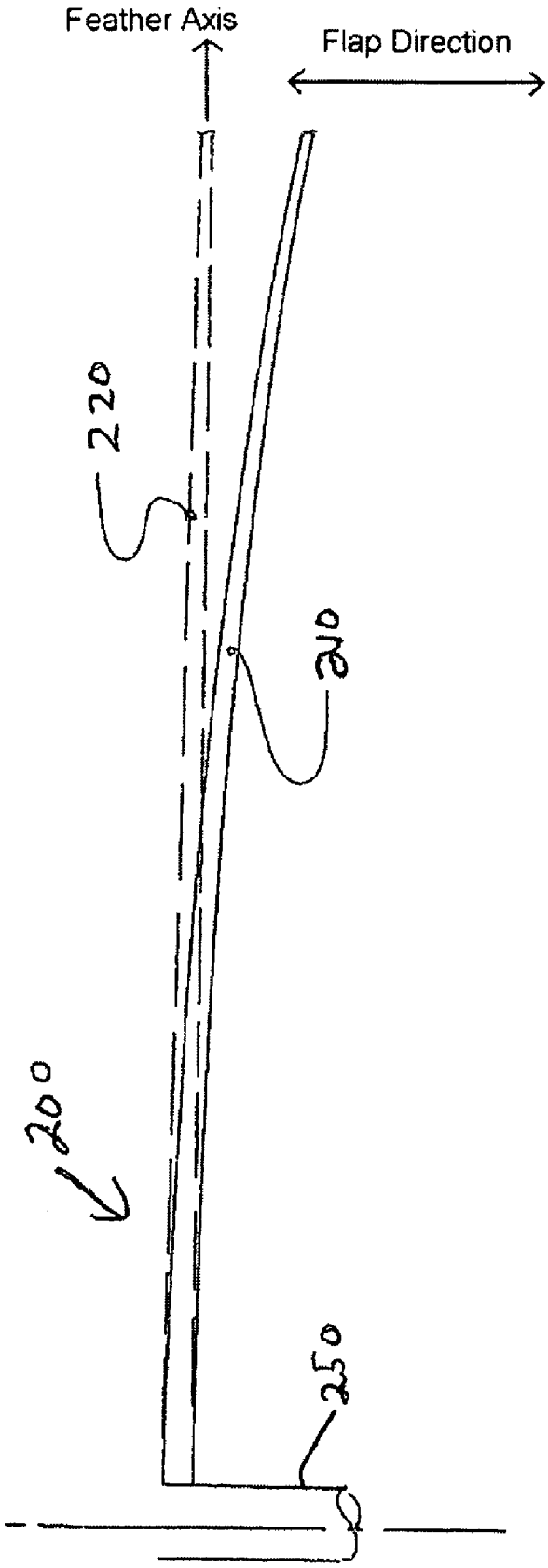
FIG. 2 is a front view of a preferred embodiment rotor blade, pre-deflected in the flap direction using solid lines, and as deflected under lift load using dashed lines.

In FIG. 2, an inventive blade 200 extends from a rotating mast 250. Unloaded the blade 200 takes the configuration 210, and under lifting load the blade takes the configuration 220 shown in dashed lines.

Figure 3:
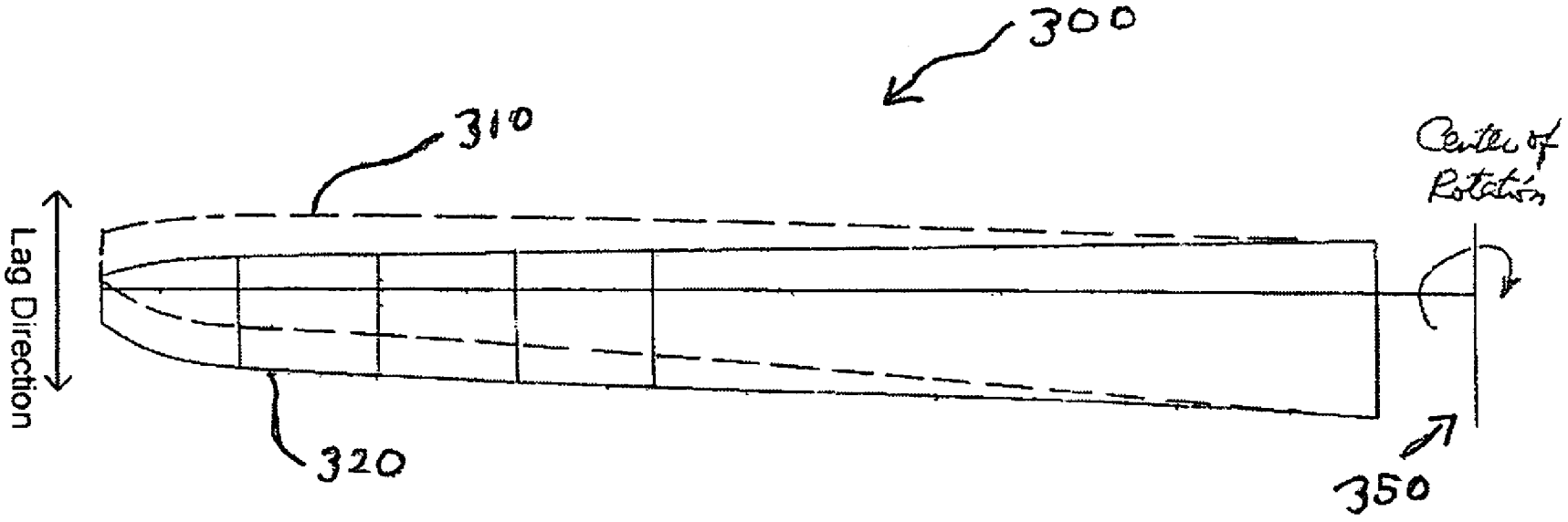
FIG. 3 is a plan view of another embodiment in which the rotor blade is pre-deflected in the lag direction using solid lines, and as deflected under drag load in dashed lines.

FIG. 3 shows an inventive blade 300 extending from a rotating mast 350. Unloaded, the blade 300 takes the configuration 310 (shown in dashed lines), and under drag load the blade takes the configuration 320 (shown in solid lines). Thus, blade 300 is pre-bent in the forward-aft direction (lag bending in the rotorcraft vernacular) under drag loads, rather than being pre-bent in the up-down direction (flap bending in the rotorcraft vernacular) under lift loads as shown in FIG. 2. In either case, or in the combined case of lag bending and flap bending, the pre-bend blade is preferably altered away from the blade feather axis in at least one direction from at least R70, more preferably from at least R50, and most preferably from at least R30.

Figure 4:
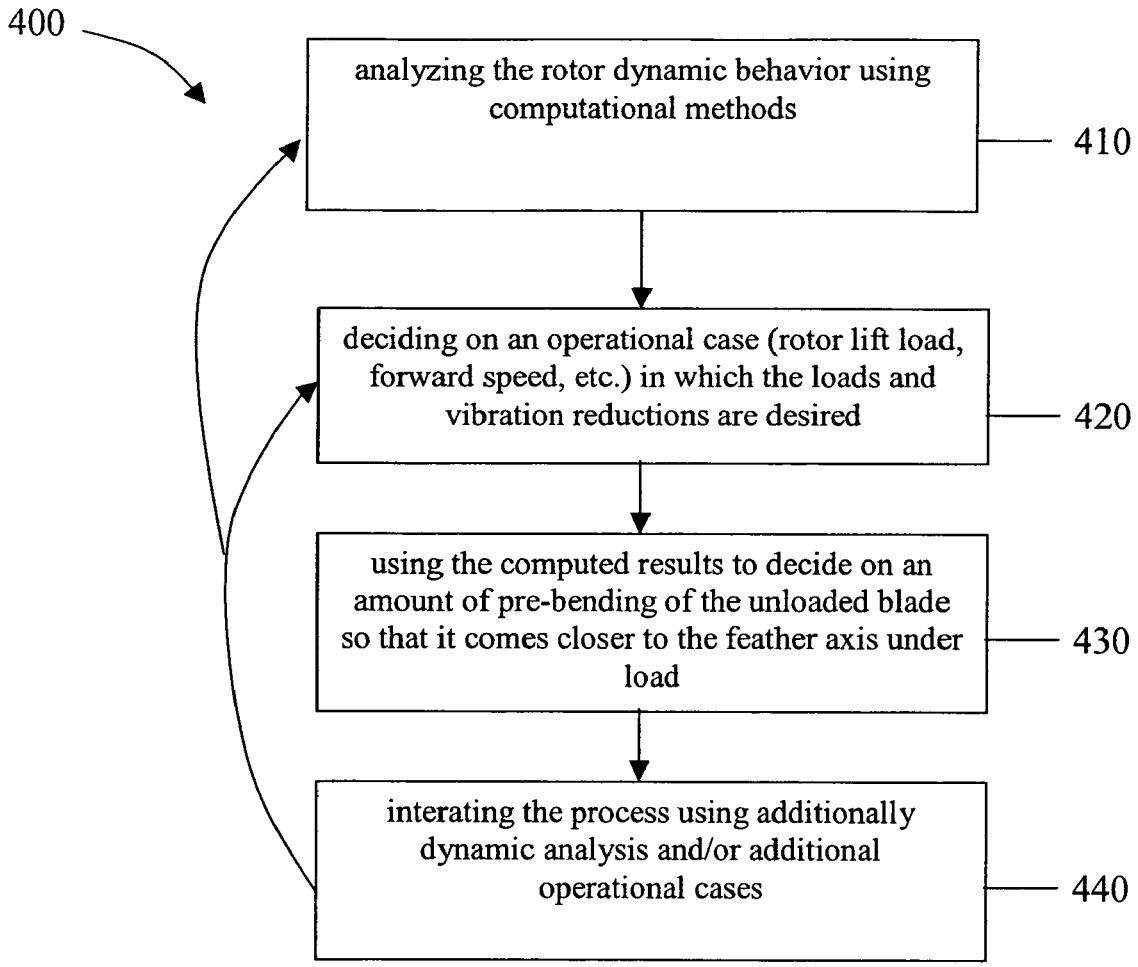
FIG. 4 is a flowchart of steps and optional steps in a preferred class of methods.

One class of preferred methods 400 shown in FIG. 4 comprises: step 410—analyzing the rotor dynamic behavior using computational methods; step 420—deciding on an operational case (rotor lift load, forward speed, etc.) in which the loads and vibration reductions are desired; and step 430: using the computed results to decide on an amount of pre-bending of the unloaded blade so that it comes closer to the feather axis under load. Step 440 iterates the process using additional dynamic analysis and/or additional operational cases. Any suitable modeling software can be used, including especially Wayne Johnson's CAMRADII.

It should be appreciated that the term "pre-bending" does not necessarily mean that the blade will be manufactured as a straight blade, and then bent before installation. "Pre-bending" can also, and more preferably, be accomplished by manufacturing the blade in the first place in a configuration that will approximate the feather axis under either or both of lift and drag loads.

Figure 5:
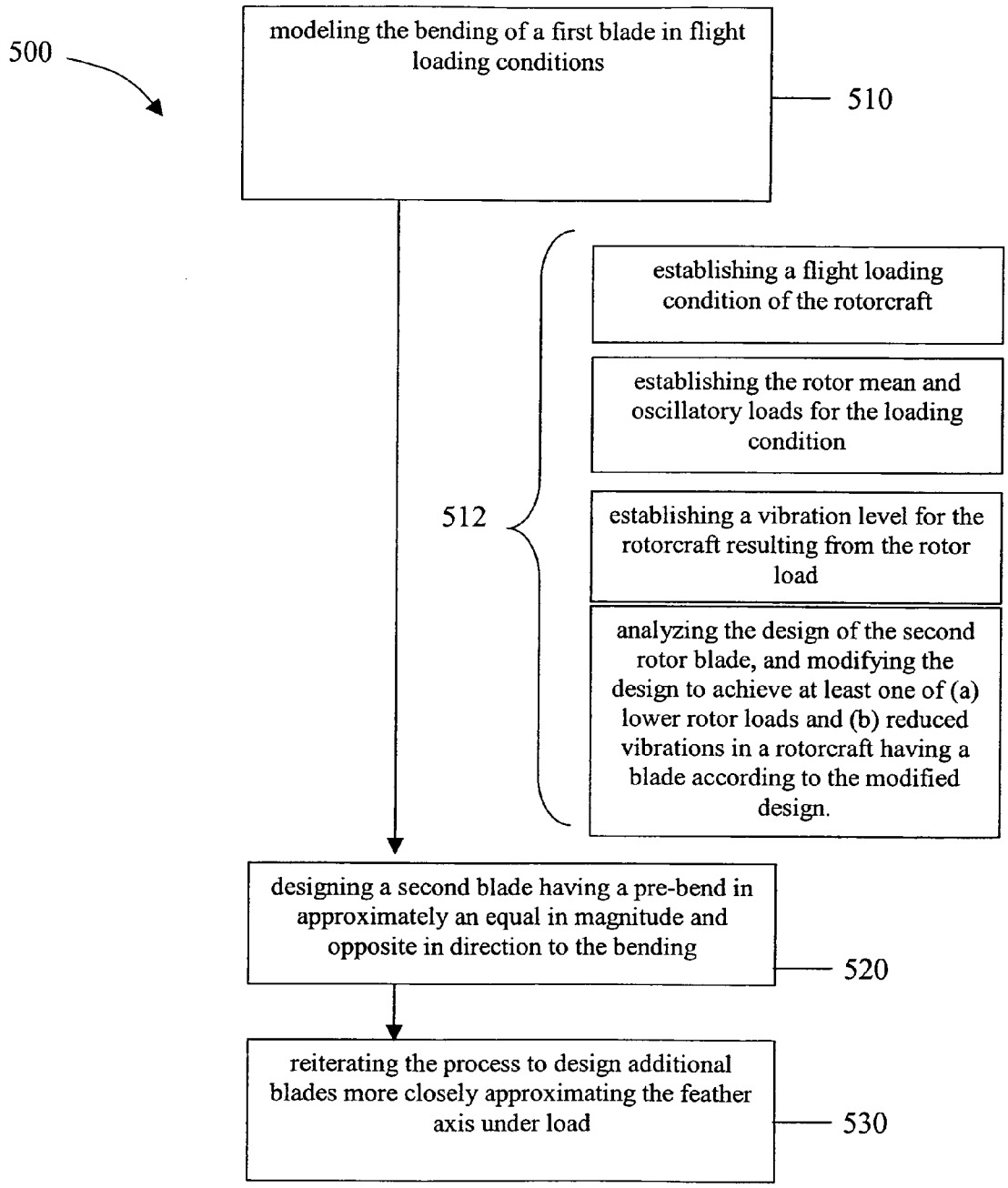
FIG. 5 is s a flowchart of steps and optional steps in another preferred class of methods.

Another class of preferred methods 500 is shown in FIG. 5. There, step 510—modeling the bending of a first blade in flight loading conditions, and then step 520—designing a second blade having a pre-bend in approximately an equal in magnitude and opposite in direction to the bending. That process can be iterated to develop additional designs, with one or more additional designs more closely approximating the feather axis under load. Preferred embodiments can further include one or more of the following steps, collectively labeled 512—establishing a flight loading condition of the rotorcraft; establishing the rotor mean and oscillatory loads for the loading condition; establishing a vibration level for the rotorcraft resulting from the rotor load; and analyzing the design of the second rotor blade, and modifying the design to achieve at least one of (a) lower rotor loads and (b) reduced vibrations in a rotorcraft having a blade according to the modified design.

As used herein, the term "establishing" should be interpreted broadly to include determining, estimating, calculating, and so forth, in other words the term contemplates that there can be some degree of ambiguity. Also as used herein the term "approximately" means within 5% on average.

Thus, specific embodiments, applications, and methods have been disclosed in which rotorcraft blades are pre-bent over a very significant length of the rotor. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . . and N, the text should be interpreted as requiring only one element from the group, not A plus N, or B plus N, etc.

What is claimed is:

1. A rotorcraft having a rotor blade that in an unloaded state has a manufactured pre-bent portion in a downward flap direction, and wherein the pre-bent portion comprises at least 20% of a length of the blade, and wherein the blade has a feathering axis, and the pre-bent portion is sized and dimensioned such that a flight loaded condition exists for which the pre-bent portion lies along the feathering axis.

2. The rotorcraft of claim 1, wherein the pre-bent portion comprises at least 40% of a length of the blade.

3. The rotorcraft of claim 1, wherein the pre-bent portion comprises at least 60% of a length of the blade.

4. The rotorcraft of claim 1, wherein the pre-bent portion is in the flap direction.

5. The rotorcraft of claim 1, further comprising the second blade having a manufactured pre-bend in a lag direction.

6. The rotorcraft of claim 1, wherein a distal end of the pre-bent portion in the unloaded state forms an angle of at least 1 degree with a root of the blade.

7. The rotorcraft of claim 1, wherein a distal end of the pre-bent portion in the unloaded condition forms an angle of at least 2 degrees with a root of the blade.

8. The rotorcraft of claim 1 wherein the pre-bent portion is bent in both the downward flap direction and in a lag direction.

9. A method, comprising:

computing a bending of a first rotor blade of a rotorcraft in a flight loading condition relative to a feathering axis;

designing a second rotor blade having a pre-bent portion approximately equal in magnitude and opposite in direction to the bending, and such that the pre-bent portion is sized and dimensioned such that a flight loaded condition exists for which the pre-bent portion lies along the feathering axis; and manufacturing the second rotor blade to include the pre-bent portion.

10. The method of claim 9, further comprising establishing a flight loading condition of the rotorcraft.

11. The method of claim 9, further comprising establishing mean and oscillatory loads of the first rotor blade for the flight loading condition.

12. The method of claim 11, further comprising establishing a vibration level for the rotorcraft resulting from the rotor loads.

13. The method of claim 9, further comprising analyzing a design of the second rotor blade, and engineering the pre-bent portion to achieve at least one of (a) lower rotor loads and (b) reduced vibrations in a rotorcraft having a blade according to the modified design.

14. The method of claim 9, further comprising analyzing a design of the second rotor blade, and engineering the pre-bent portion to achieve higher rotor efficiency in a rotorcraft having a blade according to the modified design.

* * * * *